US008910839B2

(12) United States Patent
Clifton

(10) Patent No.: US 8,910,839 B2
(45) Date of Patent: Dec. 16, 2014

(54) LOCKING DEVICE SAFETY MECHANISM AND RELATED HOLSTER ASSEMBLY

(75) Inventor: Norman E. Clifton, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 527 days.

(21) Appl. No.: 13/008,272

(22) Filed: Jan. 18, 2011

(65) Prior Publication Data

US 2011/0174849 A1 Jul. 21, 2011

Related U.S. Application Data

(60) Provisional application No. 61/295,876, filed on Jan. 18, 2010.

(51) Int. Cl.
*F41C 33/00* (2006.01)
*F41C 33/02* (2006.01)

(52) U.S. Cl.
CPC ..... *F41C 33/0209* (2013.01); *F41C 33/0263* (2013.01); *Y10S 224/911* (2013.01); *Y10S 224/912* (2013.01)
USPC ..... 224/243; 224/192; 224/193; 224/198; 224/238; 224/244; 224/911; 224/912; D23/222

(58) Field of Classification Search
CPC ..... F41C 33/0263; F41C 33/0227
USPC ..... 224/192, 193, 198, 238, 243, 244, 911, 224/912; D23/222
IPC ..... F41C 33/00
See application file for complete search history.

(56) References Cited

U.S. PATENT DOCUMENTS

| | | | | | |
|---|---|---|---|---|---|
| 3,630,420 | A * | 12/1971 | Bianchi | 224/193 |
| 3,910,469 | A * | 10/1975 | Baldocchi | 224/198 |
| 4,325,505 | A * | 4/1982 | Hillman | 224/238 |
| 5,275,217 | A * | 1/1994 | Eakin | 150/132 |
| 6,112,962 | A * | 9/2000 | Matthews | 224/243 |
| 6,371,341 | B1 * | 4/2002 | Clifton, Jr. | 224/243 |
| 7,461,765 | B2 * | 12/2008 | French et al. | 224/243 |
| 7,556,181 | B2 * | 7/2009 | Spielberger | 224/244 |
| 7,922,050 | B2 * | 4/2011 | Beneš | 224/244 |
| 2004/0050887 | A1 * | 3/2004 | Spielberger | 224/244 |
| 2006/0011680 | A1 * | 1/2006 | Cook et al. | 224/243 |
| 2006/0157520 | A1 * | 7/2006 | Clifton, Jr. | 224/243 |
| 2007/0175935 | A1 * | 8/2007 | Clifton, Jr. | 224/243 |

FOREIGN PATENT DOCUMENTS

IT EP1382931 * 7/2003 ..... F41C 33/02

* cited by examiner

*Primary Examiner* — Brian D Nash
*Assistant Examiner* — Derek Battisti
(74) *Attorney, Agent, or Firm* — Arthur G. Yeager

(57) ABSTRACT

A firearm holster assembly includes a holster pocket having an interior volume for accommodating a firearm within, a locking device mounted within the interior volume for selectively impeding the withdrawal of the firearm therefrom, the locking device including an operating lever extending outwardly from the holster pocket and operable to disengage the locking device from the firearm, and a locking device safety mechanism mounted to the holster pocket and including an operating arm operable to selectively inhibit operation of the operating lever.

15 Claims, 4 Drawing Sheets

LOCKING DEVICE SAFETY MECHANISM AND RELATED HOLSTER ASSEMBLY

CROSS-REFERENCE TO RELATED APPLICATION

This application claims the benefit of U.S. Provisional Application Ser. No. 61/295,876, filed on Jan. 18, 2010, the contents of which are herein incorporated by reference in their entirety.

FIELD OF THE INVENTION

The present invention relates to firearm holsters, and more particularly, to holster assemblies including locking devices.

BACKGROUND OF THE INVENTION

It is known to equip firearm holsters with locking devices that help prevent unwanted and/or unauthorized withdrawal of the firearm. One locking device includes a saddle with engagement protrusions that is automatically biased into engagement with suitable surfaces of the firearm to inhibit withdrawal. The locking device includes an operating lever that extends out the holster and is operable to disengage the protrusions and allow firearm withdrawal. An example of this locking device can be seen in U.S. Patent Application Publication No. 2006/0157520, the contents of which are hereby incorporated by reference in their entirety. This type of locking device has proven very serviceable. However, additional developments and improvements are possible.

SUMMARY OF THE INVENTION

In view of the foregoing, it is an object of the present invention to provide an improved holster assembly. In particular, it is an object of the present invention to provide a locking device safety mechanism for a holster assembly that is selectively operable by a user to inhibit and allow use of a locking device.

According to an embodiment of the present invention, a locking device safety element includes a mounting plate adapted for attachment to a holster assembly including a locking device, and an operating arm pivotally mounted to the mounting plate and selectively moveable between a blocking position and a clear position.

According to an aspect of the present invention, the operating arm includes a resilient leg that extends into detents on the mounting plate when in the blocking and clear positions, such that movement of the operating arm between positions requires compression of the resilient leg relative to the operating arm.

These and other objects, aspects and advantages of the present invention will be better appreciated in view of the drawings and following detailed description of a preferred embodiment.

DETAILED DESCRIPTION OF A PREFERRED EMBODIMENT

Figure 2:
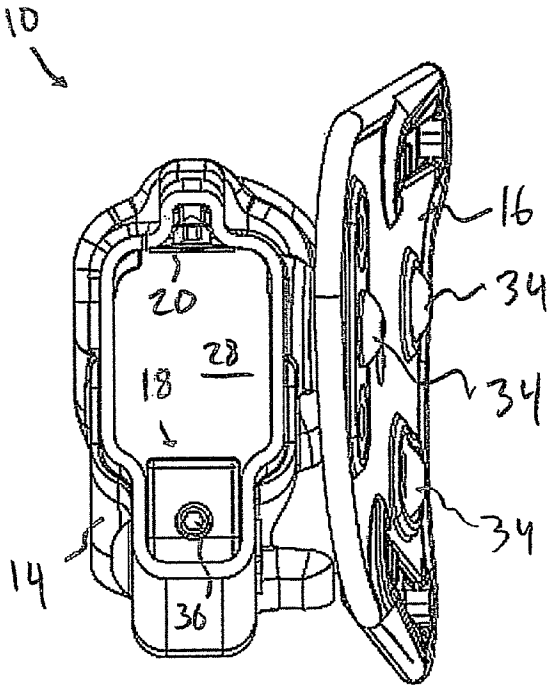
FIG. 2 is a bottom view of the holster assembly of FIG. 1, with the firearm removed.
Figure 1:
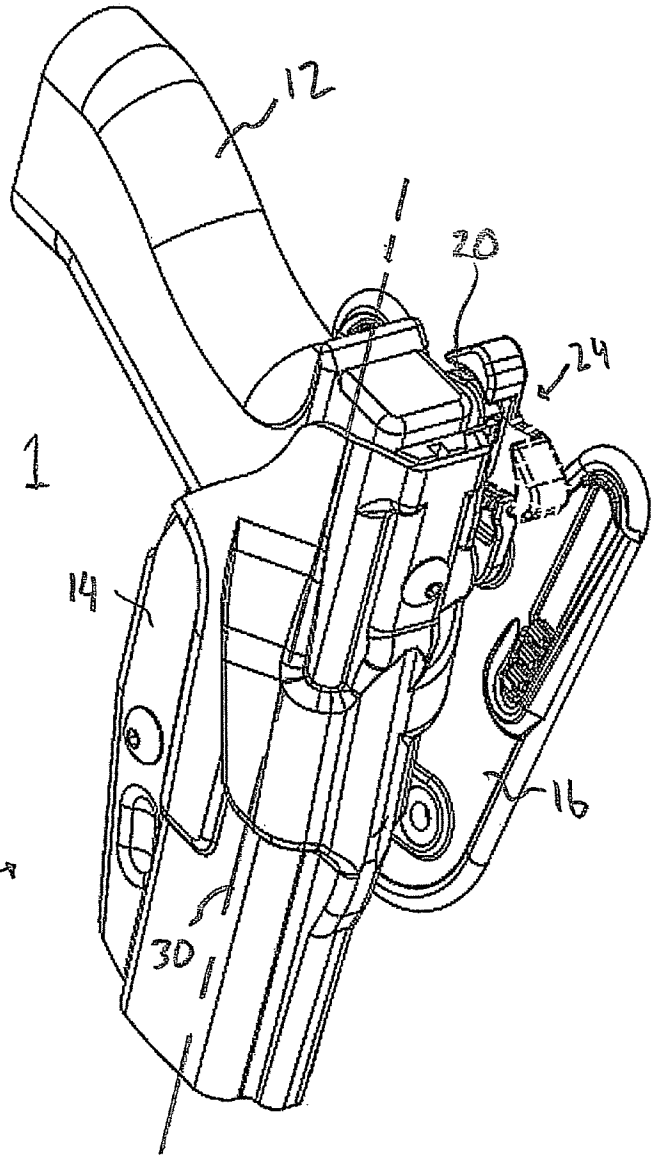
FIG. 1 is a perspective view of a holster assembly for a firearm, including a holster pocket, belt attachment plate, locking device and locking device safety mechanism, according to an embodiment of the present invention, with the firearm shown therewith and with an alternate safety mechanism position shown in broken lines.

Referring to FIGS. 1 and 2, according to an embodiment of the present invention, a holster assembly 10 for a firearm 12 includes a holster pocket 14, a belt attachment plate 16, an adjustable tension device 18, a locking device 20, and a locking device safety mechanism 24.

The holster pocket 14 is preferably a rigidly molded structure defining an interior volume 28 and extending along an elongated holster axis 30. The interior volume 28 is dimensioned to generally conform to the portion of the firearm 12 inserted therein.

The belt attachment plate 16 is releasably connected to an external side of the holster pocket 14 using a plurality of fasteners 34, and allows releasable mounting of the holster assembly 10 to a belt, harness or other connection point on a firearm user. The belt attachment plate 16, as well as the rest of the holster assembly 10, are adapted for a right-hand draw arrangement. It will be appreciated that a left-handed draw arrangement is readily achieved using a mirror image of the holster assembly 10.

The adjustable tension device 18 is arranged proximate a muzzle end of the holster pocket 14 and assists in ensuring proper positioning of the firearm 12 for engagement by the locking device 20. The adjustable tension device 18 is adjustable via a set screw 36 to accommodate some variation in firearm dimensions.

Figure 4:
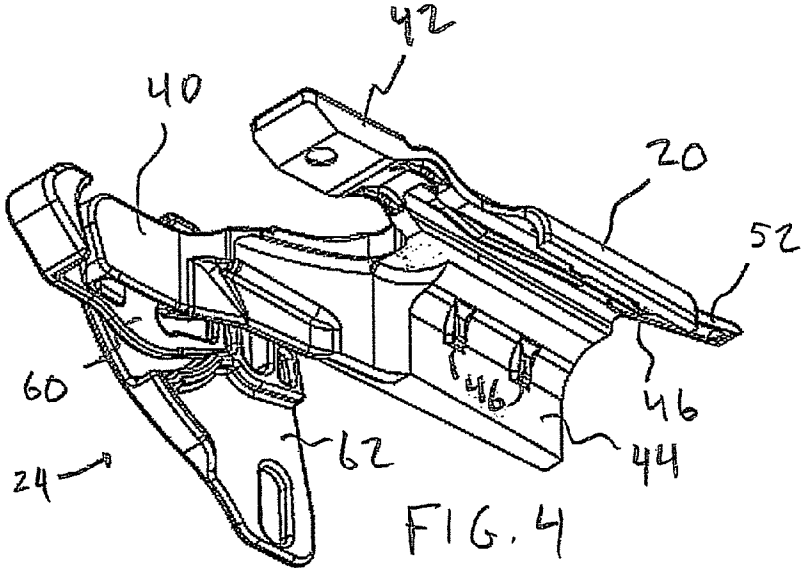
FIG. 4 is a perspective view of the locking device and locking device safety mechanism of FIG. 1, in a blocking position.
Figure 5:
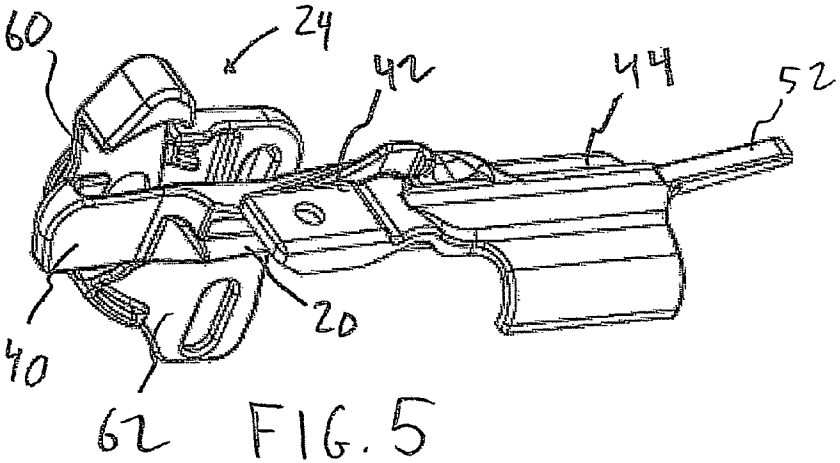
FIG. 5 is a perspective view of the locking device and locking device safety mechanism of FIG. 1, in a clear position.
Figure 3:
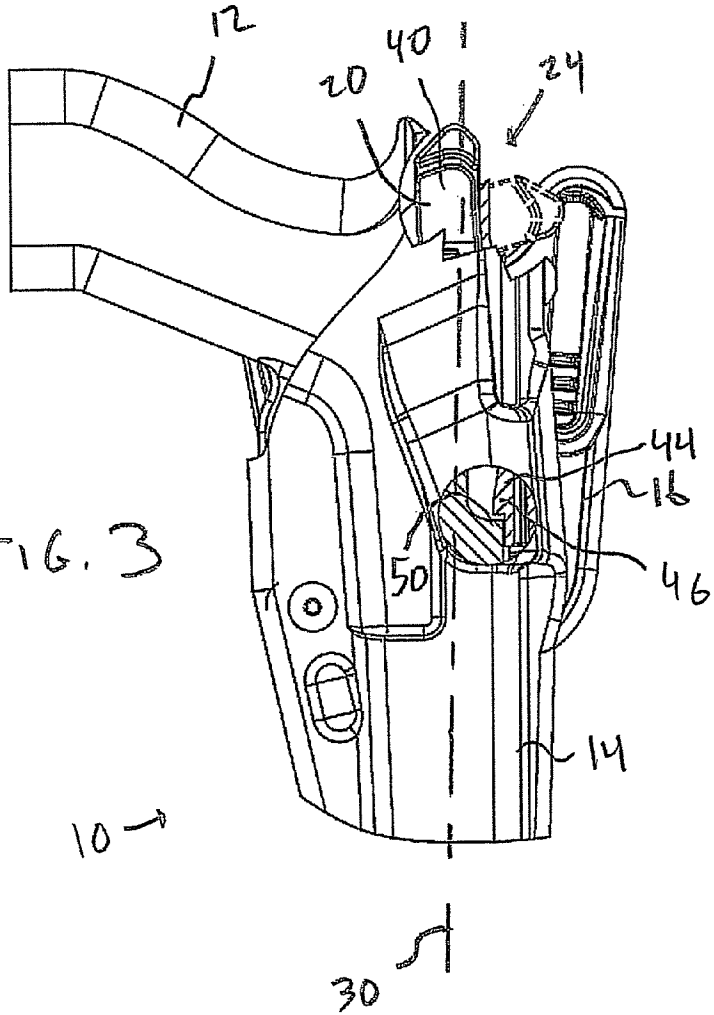
FIG. 3 is a side view of the holster assembly of FIG. 1, with components partially cutaway to show details and with an alternate safety mechanism position shown in broken lines.

Referring to FIGS. 3-5, the locking device 20 is mounted within the interior volume 28 of the holster pocket 14 by a mounting pad 42 pivotably connected to a saddle 44. An operating lever 40 extends outwardly from the saddle 44 generally parallel to the holster axis 30 and is manipulable adjacent to a rear end of the firearm 12 to pivot the locking device about an axis generally perpendicular to the holster axis 30.

The saddle 44 is dimensioned to accommodate an upper portion of the firearm 12 extending thereunder. Firearm engagement protrusions 46 extend from the saddle 44 to releasably engage an ejection port 50, or other suitable surface, of the firearm 12.

The locking device 20 is preferably arranged in the holster pocket 14 such that the naturally resiliency of the saddle 44 relative to the mounting pad 42 will urge the protrusions 46 into engagement with the firearm 12. If desired, a resilient extension 52 can extend from the saddle 44 to supplement the natural resiliency.

With the protrusions 46 engaging the firearm 12, withdrawal of the firearm 12 is inhibited. Withdrawal of the firearm 12 is permitted by using the operating lever 40 to pivot the saddle 44 away from the firearm 12, such that the protrusions 46 disengage from the firearm 12.

Figure 6:
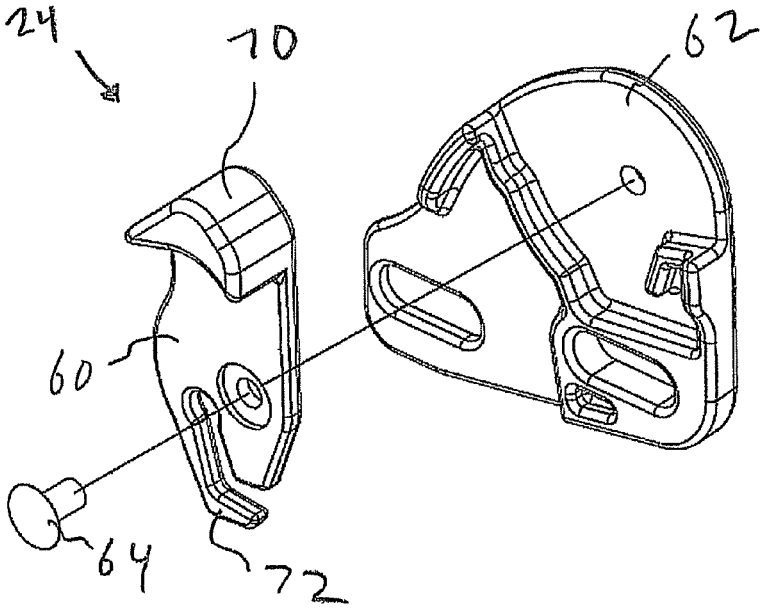
FIG. 6 is an exploded perspective view of the locking device safety mechanism of FIG. 1.
Figure 9:
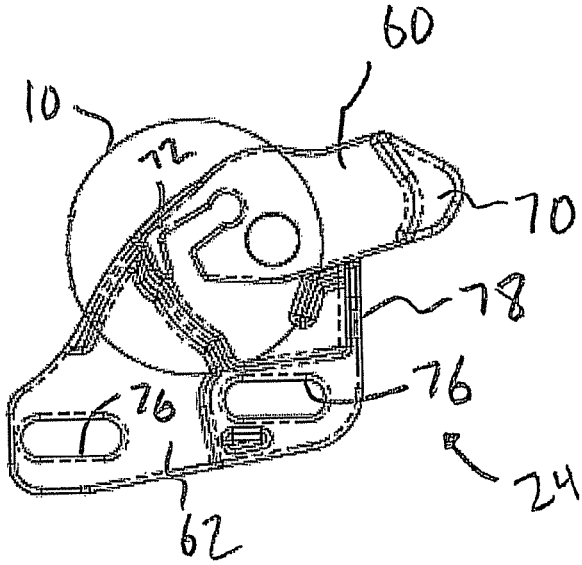
FIG. 9 is a side view of the locking device safety mechanism of FIG. 1, in the clear position.
Figure 10:
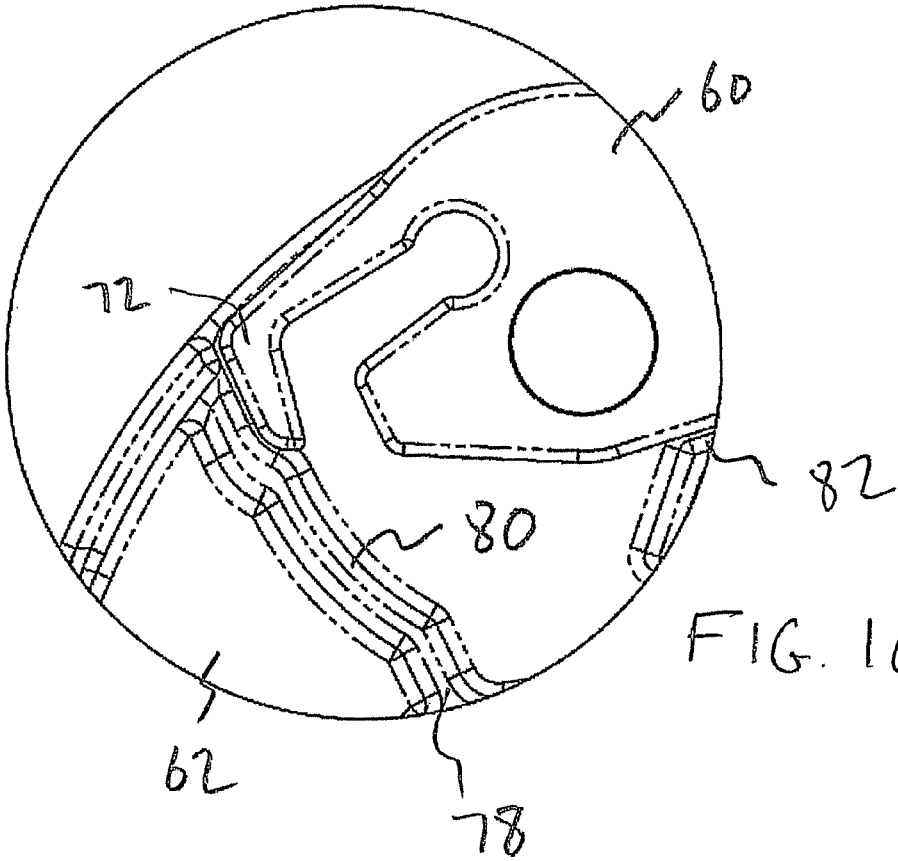
FIG. 10 is a detail view of area 10 of FIG. 9.

Referring to FIGS. 1 and 2, the locking device safety mechanism 24 is mounted exteriorly to the holster pocket 14, between a side of the holster pocket 14 and the belt attachment plate 16, releasably secured by one or more of the fasteners 34 used to secure the belt attachment plate 16 to the holster pocket 14. Referring to FIGS. 4-6, the safety mechanism 24 includes an operating arm 60 and a mounting plate 62. The operating arm 60 is pivotably connected to the mounting plate 62 by a pivot pin 64 and is selectively pivotable between a blocking position, (FIGS. 4, 7 and 8, and solid lines of FIGS. 1 and 3) and a clear position (FIGS. 5, 9 and 10, and broken lines of FIGS. 1 and 3). In the blocking position, the operating arm 60 inhibits operation of the operating lever 40, and in the clear position, the operating arm 60 allows operation of the operating lever 40.

Figure 7:
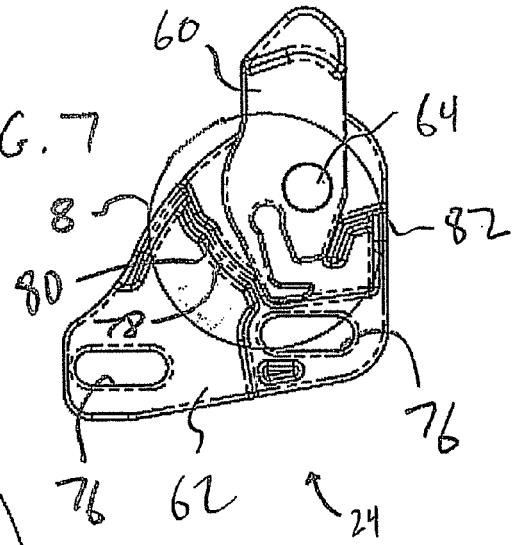
FIG. 7 is a side view of the locking device safety mechanism of FIG. 1, in the blocking position.
Figure 8:
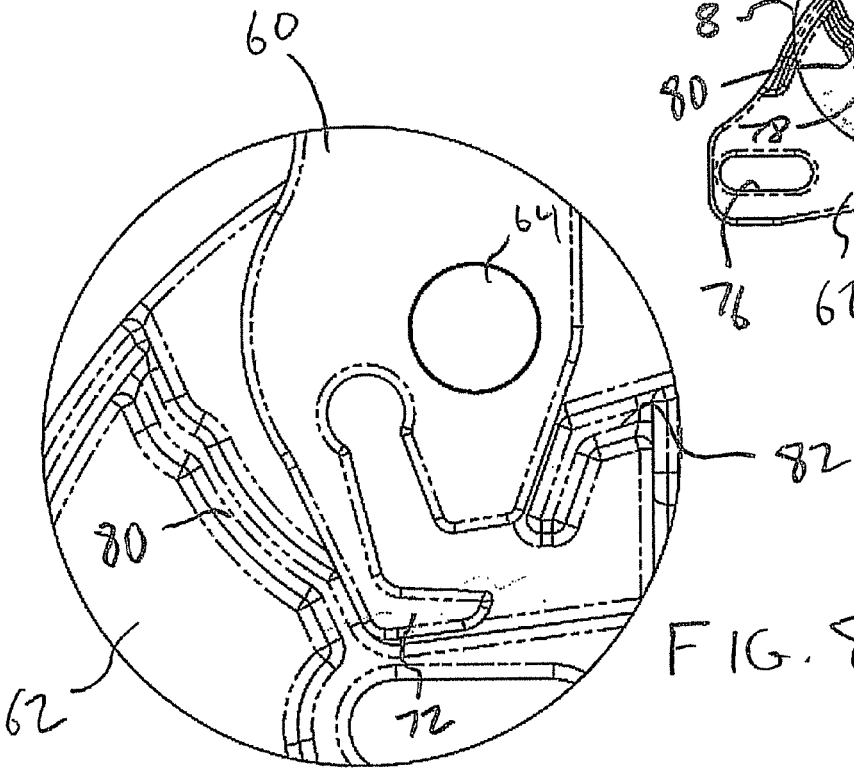
FIG. 8 is a detail view of area 8 of FIG. 7.

Referring to FIGS. 6-8, the operating arm 60 includes a first end with a thumb tab 70 and a second end with a resilient leg 72. The thumb tab 70 facilitates use, as well as shielding, of the operating lever 40 with the operating arm 60 in the blocked position. Functioning of the resilient leg 72 will be described in greater detail below.

The mounting plate 62 defines mounting holes 76, through which fasteners 34 are inserted (see FIG. 2). The mounting plate 62 includes an operating arm engagement wall 78. The wall 78 includes a resilient leg detent section 80 and an operating arm limit section 82.

Referring to FIGS. 7-10, the detent section 80 defines detents into which the resilient leg 72 extends in the blocking (FIGS. 7 and 8) and clear (FIGS. 9 and 10) positions. As a result, moving the operating arm 60 between positions requires compression of the leg 72 relative to the rest of the arm 60, decreasing the likelihood of inadvertent operation and supplying a tactile position indication to the user. The limit section 82 engages the operating arm to prevent pivotal movement beyond the blocking and clear positions.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A firearm holster assembly comprising:

a holster pocket having an interior volume for accommodating a firearm therewithin;

a locking device mounted within the interior volume of the holster pocket for selectively impeding the withdrawal of the firearm therefrom, the locking device including an operating lever extending outwardly from the holster pocket and operable by a user to disengage the locking device from the firearm; and a locking device safety mechanism mounted to the holster pocket and including an operating arm selectively operable to pivot forwardly to clear the operating lever and remain in that position until returned by a user and to overlie and inhibit access to and operation of the operating lever, the operating arm having a thumb tab at its upper end which selectively blocks and shields the operating lever from being engaged until the thumb tab is moved to a clear position that does not block or shield the operating lever;

the locking device safety mechanism further includes a mounting plate and a pivot connection to which the operating arm is pivotably connected, the mounting plate releasably engages the operating arm in a blocking position which inhibits operation of the operating lever, and is pivoted by the user to a clear position, in which the operating arm permits access to and operation of the operating lever of the locking device.

2. The assembly of claim 1, wherein the operating arm includes a resilient leg and the mounting plate includes a pair of spaced detents that releasably engage the resilient leg respectively in the blocking and the clear position.

3. The assembly of claim 2, wherein the mounting plate includes an operating arm engagement wall, the pair of spaced detents being located in a resilient leg detent section of the operating arm engagement wall.

4. The assembly of claim 3, wherein the operating arm engagement wall further includes an operating arm limit section, the operating arm limit section limiting the pivotal motion of the operating arm beyond the blocking and clear positions.

5. The assembly of claim 1, wherein the locking device includes a saddle from which the operating lever extends, the saddle being dimensioned to accommodate an upper portion of the firearm thereunder, the saddle having at least one firearm engagement protrusion extending therefrom for releasable engagement with a corresponding surface of the firearm, the operating lever being operable to disengage the engagement protrusion from the corresponding surface of the firearm.

6. The assembly of claim 1, further comprising an adjustable tension device arranged proximate a muzzle end of the holster pocket and adjustable for proper positioning of the firearm by the locking device.

7. A locking device safety mechanism for a firearm holster assembly having a locking device within a holster of the holster assembly and an elongate operating lever with an end within the holster operable with the locking device to open the locking device and a free end outwardly of the holster and engageable by a thumb of a user to unlock the locking device, the mechanism comprising:

a safety mounting plate adapted for mounting the holster; and a safety operating arm pivotably connected to the mounting plate and having a first end with a safety thumb tab and a second end overlying the mounting plate, such that, with the mounting plate mounted to the holster, the safety operating arm is selectively pivotable from a blocking position in which the safety thumb tab covers and blocks access to the end of the locking device elongate operating lever and any unlocking movement by the elongate operating lever until a user moves the safety thumb tab forward to a clear position to permit unlocking movement of the operating lever.

8. The mechanism of claim 7, wherein the mounting plate releasably engages the safety operating arm in a blocking position, and in such blocking position the operating arm prevents movement of the operating lever, and in the clear position, the safety operating arm permits operation of the operating lever.

9. The assembly of claim 8, wherein the safety operating arm second end includes a resilient leg and the mounting plate includes a pair of spaced detents that releasably and respectively engage the resilient leg in the blocking and clear positions.

10. The mechanism of claim 9, wherein the mounting plate includes an operating arm engagement wall, the pair of spaced detents being located in a resilient leg detent section of the operating arm engagement wall.

11. The mechanism of claim 10, wherein the operating arm engagement wall further includes an operating arm limit section, the operating arm limit section limiting the pivotal motion of the safety operating arm beyond the blocking and clear positions.

12. A firearm holster assembly comprising:

a holster pocket having an interior volume for accommodating a firearm there within;

a locking device mounted within the interior volume for selectively impeding the withdrawal of the firearm therefrom, the locking device including a saddle having at least one firearm engagement protrusion extending therefrom for releasable engagement with a corresponding surface of the firearm, and an operating lever extending from the saddle out of the holster pocket, the operating lever being operable to disengage the engagement protrusion from the corresponding surface of the firearm; and a locking device safety mechanism mounted to the holster pocket and including an operating arm having a first end with a thumb tab and a second end with a resilient leg, and a mounting plate mounted to the holster pocket with the operating arm pivotably connected thereto, the mounting plate having a pair of spaced detents that selectively releasably and engage the resilient leg, respectively, in a clear position and a blocking position, in which the first thumb tab overlies and shields the operating lever, and in the clear position, in which the thumb tab is moved forward to a clear position of the operating lever and permits access by a user to the operating lever of the locking device.

13. The assembly of claim 12, further comprising a belt attachment plate mounted exteriorly to the holster pocket by at least one fastener, the locking mounting plate being mounted to the holster pocket by the at least one fastener, between the belt attachment plate and the holster pocket.

14. The mechanism of claim 12, wherein the mounting plate includes an operating arm engagement wall, the pair of spaced detents being located in a resilient leg detent section of the operating arm engagement wall.

15. The mechanism of claim 14, wherein the operating arm engagement wall also has an operating arm limit section, the operating arm limit section limiting the pivotal motion of the operating arm beyond the blocking and clear positions.

* * * * *